US005253558A

United States Patent [19]

Guddal, Jr.

[11] Patent Number: 5,253,558

[45] Date of Patent: Oct. 19, 1993

[54] HOSE CUTTING APPARATUS AND SYSTEM, AND METHOD FOR USING SAME

[75] Inventor: Kenneth J. Guddal, Jr., St. Paul, Minn.

[73] Assignee: Marken Manufacturing, Inc., St. Paul, Minn.

[21] Appl. No.: 807,045

[22] Filed: Dec. 12, 1991

[51] Int. Cl.[5] ..... B26D 3/16; B26D 7/14

[52] U.S. Cl. ..... 83/18; 83/22; 83/54; 83/175

[58] Field of Search ..... 83/18, 20, 54, 175, 83/176, 113, 118, 165, 363, 369, 169, 22, 170, 171

[56] References Cited

U.S. PATENT DOCUMENTS

| | | | |
|---|---|---|---|
| 2,293,721 | 8/1942 | Engler | 83/20 |
| 3,066,564 | 12/1962 | Carpenter | 83/176 X |
| 3,232,159 | 2/1966 | Stanley | 83/175 |
| 3,863,538 | 2/1975 | Behnke | 83/54 X |
| 3,978,747 | 9/1976 | Lyon | 83/18 |
| 4,657,068 | 4/1987 | Peltz | 83/169 X |
| 4,951,569 | 8/1990 | McNab et al. | 83/176 X |
| 4,987,808 | 1/1991 | Sicka et al. | 83/175 X |

OTHER PUBLICATIONS

Circular Saws, Startrite, Catalog C-85, Startrite, Inc., Kalamazoo, Mich., Jun. 29, 1988.

*Primary Examiner*—Frank T. Yost
*Assistant Examiner*—Rinaldi Rada
*Attorney, Agent, or Firm*—Merchant, Gould, Smith, Edell, Welter & Schmidt

[57] ABSTRACT

An apparatus and system for cutting hose includes structure which allows a portion of the hose that is proximate the trailing side of a cutting blade to be angularly displaced during cutting while a portion of the hose proximate the leading side of the cutting blade is not angularly displaced. A method for cutting hose includes the step of angularly displacing a portion of the hose that is proximate the trailing side of a cutting blade during cutting while a portion of the hose proximate the leading side of the cutting blade is not angularly displaced.

7 Claims, 10 Drawing Sheets

FIG. 9A
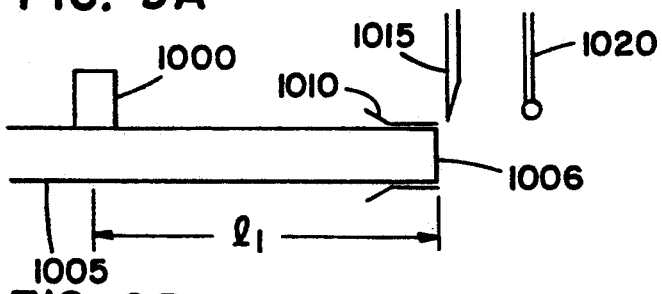
FIG. 9B
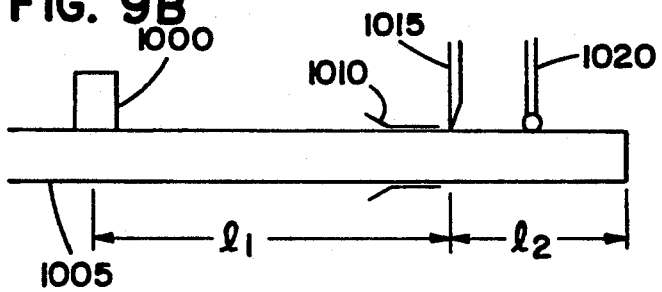
FIG. 9C
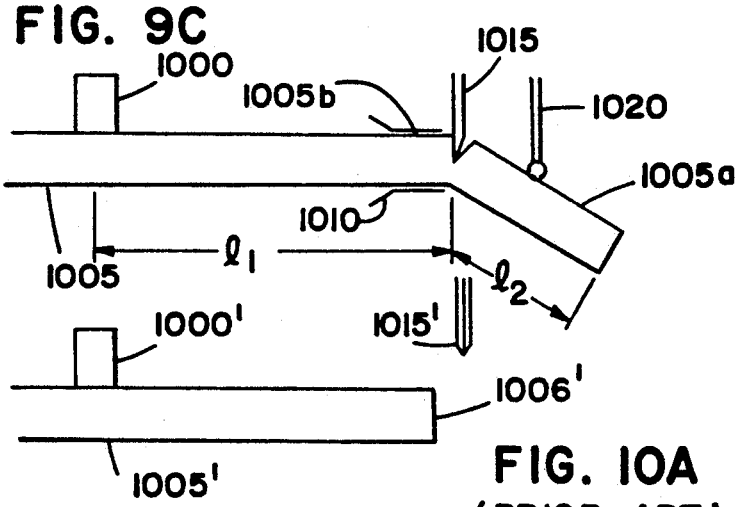
FIG. 10A
(PRIOR ART)
FIG. 4A
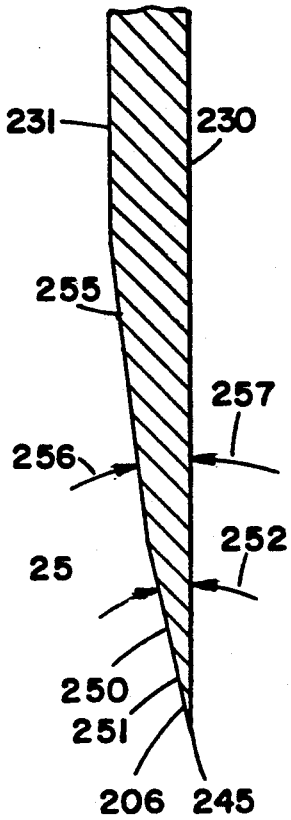
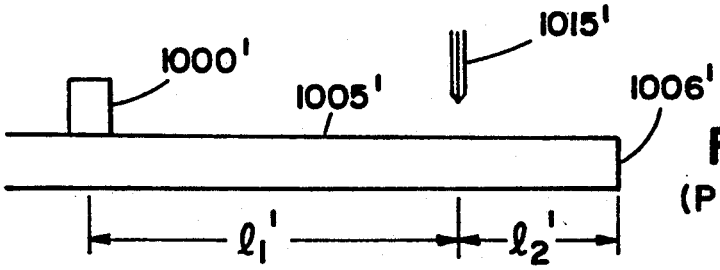
FIG. 10B
(PRIOR ART)
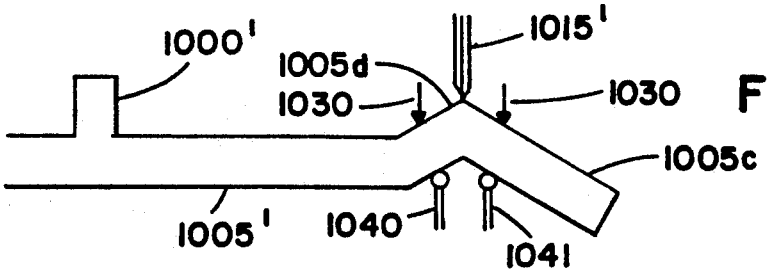
FIG. 10C
(PRIOR ART)

HOSE CUTTING APPARATUS AND SYSTEM, AND METHOD FOR USING SAME

FIELD OF THE INVENTION

The present invention relates to apparatuses and systems for cutting hose, cable or the like, and methods for using the same. In particular, the invention relates to apparatuses and systems that are adapted to cut through hose, cable, or the like, generally through the diameter of the hose, cable or the like, at a desired position along the length of the hose, cable or the like. More specifically, the present invention relates to hose cutting apparatuses and systems that are constructed and arranged to cut through a hose, cable, or the like in such a manner as to make a relatively clean, debris-free, and accurate cut. Still more specifically, the present invention relates to apparatuses and systems for cutting hoses and cables that are constructed and arranged to bend a portion of the hose such that it pulls away from a cutting edge as the cutting edge passes through the hose. The present invention further relates to apparatuses and systems that incorporate structure to support and guide a portion of a hose or cable to preclude it from bending during cutting. Additionally, the present invention relates to systems and apparatuses that is adapted to cut through hose or cable made of material subject to melting at temperatures typically encountered during cutting processes, that cools the cutting edge to avoid such melting. Finally, the present invention relates to systems constructed and arranged to cut a hose member into a desired number of hose pieces of a desired length.

BACKGROUND OF THE INVENTION

The present invention is directed to apparatus, systems and method for cutting hose, cable and the like. For convenience throughout this application, the terms "hose" or "hose member" will be used to refer to all types of hose, cable and the like that is suitable to be cut in the manner described.

Typically, hose and cable are stored on and/or dispensed from spools. Many types of hoses and cable are quite heavy and rather difficult to pull from the spool. There exist a number of types of apparatus which function to feed or pull hose, cable, or the like from a coil arrangement or other storage arrangement off of that coil or other storage arrangement. Of course, the length of hose or cable desired to be used rarely is the same as the length on a spool. Therefore, it is typically necessary to cut the hose somewhere, or at many locations along its length. There are a number of types of apparatus which cut hose, cable, or the like. There exist machines or apparatus which are constructed and arranged to cut a length of cable or hose into a desired number of pieces, having a desired length. Some such cutting machines incorporate a feeding mechanism, so that a single apparatus can pull or feed cable or hose off of a coil, and through the cutting machine, wherein a cutting edge within the machine cuts the hose at the desired length.

Certain of these machines incorporate automatic controls that allow a user to input or enter a desired number of pieces of hose, and the desired length, such that the machine will automatically feed and cut the desired number of pieces at the desired length. Examples of some such machines are "Automatic Cut-To-Length Units" available from Kabelmat®.

Known machines of this type employ gauntlet-type cutting edges, which begin in a raised position. When the hose or cable is located at the desired position, the gauntlet drops downward and slices through the cable at the desired position. These arrangements are typically pneumatically or hydraulically powered.

When cutting hose, cable, or the like, it is, of course, desirable to achieve a good quality cut. A number of parameters govern or define the quality of a cut. For example, it is desireable that the cut made by the cutting edge be relatively "clean"; i.e., be relatively smooth, as opposed to jagged. Additionally, it is desirable that the severed end of the hose be cut substantially perpendicularly to the longitudinal axis of the hose. Still further, some types of hoses or cables have an internal, axial, cavity; that is, some hoses or cable are hollow, having a wall with a particular outer diameter and internal diameter. Hoses or cables of this type will hereafter be identified as "hollow hoses". Cutting of hollow hoses presents an additional problem, in that it is undesirable for debris resulting from the cutting to be deposited within the interior or on the interior wall of the hose. If sufficient undesirable debris is deposited on the inside of the hose, each hose piece must be cleaned in some manner prior to use.

The cut quality parameters described above are illustrated in the schematic FIG. 11. A cut piece of hose A is illustrated in fragmentary cross-section. The end of the hose that illustrates the cut is designated by reference letter B. A plane defined by the face C of the cut end B most desirably is perpendicular to the longitudinal axis D of hose A, in most applications. The angle E defined between face plane C and line F, representing the plane at exactly a 90° angle from axis D, is preferably as small as possible. Additionally, it is typically desireable that face C be as smooth as possible. In the illustrations, hose A is hollow. It is illustrated in FIG. 11 with debris G from the cut deposited on the internal wall H of the hose. It is desireable that the amount of this debris be minimized so that the cut hose any fluid that might later flow through the hose in use will not be contaminated with the debris. Additionally, if little debris is deposited, the need to clean the hose before sale or use is diminished. Cleaning cut hose pieces can be relatively time-consuming and can add to the cost of the hose.

Some cables or hoses are made of a rubber or plastic material that tends to melt if exposed to sufficient amounts of heat. Oftentimes, the cutting process generates enough heat to cause such cables or hoses to melt somewhat, leaving deposits of rubber or other material on the cutting edge. Of course, such deposits make the cutting edge less effective at achieving a high quality cut. As a result, cutting blades with deposits thereon must be replaced more often than would otherwise be necessary, increasing the cost of cutting hose.

Still further, some types of hoses or cables are reinforced with metal, typically steel. Considerable amounts of force may be required to cleanly cut through such hoses or cables. Frequently, the gauntlet-type pneumatic or hydraulic cutting devices are inadequate to properly sever such reinforced hoses or cables.

One type of hose which has all three of the immediately-above-identified characteristics (i.e., hollow, contains rubber, and reinforced) is hydraulic hose cable. The conventional gauntlet-type cutting edges, powered pneumatically or hydraulically, have been found to operate with insufficient force to cleanly cut through hydraulic hose.

Another problem associated with cutting hose and the like is that as a blade posses through the hose, it may bind. That is, the blade is stopped or slowed from passing further through the hose, due to force exerted on it from the faces of the hose on opposite sides of the cut. To address this problem, it has been known to bend the hose away from the cut as the blade passes through the hose. The previously known manner of doing this will be discussed in the Detailed Description below, and will be contrasted with the manner proposed herein for preventing or reducing the binding effect.

Thus, it can be seen that what has been needed is a machine or apparatus, system, and method for cutting cables or hoses, particularly those that are hollow, contain rubber and/or are reinforced, such as hydraulic hose, in a manner that produces high quality cuts. It is still further desirable that such machine be adapted to make the desired cuts, without producing significant amounts of debris deposited on the inside of a hollow hose. It is further desirable that such apparatus, system, and method constructed and arranged to make the desired cuts without portions of the hose melting onto the cutting edge. Further, it is desirable that such apparatus, system, or method, provide for the automatic cutting of a length of such hose into pieces of a desired length.

OBJECTS OF THE INVENTION

Thus, it is an object of this invention to provide a machine or apparatus, system, and method for cutting cables or hoses, particularly those that are hollow, contain rubber and/or are reinforced, such as hydraulic hose, in a manner that produces high quality cuts. It is still further an object of this inveniton to provide that such machine be adapted to make the desired cuts, without producing significant amounts of debris deposited on the inside of a hollow hose. It is further an object of this invention to provide such apparatus, system, and method constructed and arranged to make the desired cuts without portions of the hose melting onto the cutting edge. Further, it is desirable that such apparatus, system, or method, provide for the automatic cutting of a length of such hose into pieces of a desired length.

SUMMARY OF THE INVENTION

The present invention concerns an apparatus, system, and method for cutting hoses, cables, or the like. It is constructed and arranged to cut hollow hoses and the like with relatively small amounts of debris being deposited in the interior wall of the hose. It is constructed and arranged to cut through hoses containing materials which tend to melt during cutting processes that tend to produce heat. Further, it is particularly constructed and arranged to adequately cut through reinforced hoses, cables, and the like.

The apparatus includes cutting means including a cutting edge. Still further, the apparatus includes means for bending a portion of the hose during cutting, the bending means or structure being located spaced from the cutting edge, and on the opposite side of the cutting means from the measuring device. Still further, the apparatus includes means or structure for supporting a hose that is passing through the apparatus, the supporting means being located between the measuring device and the leading side of the cutting edge. The supporting structure precludes a portion of the hose from bending during cutting. Additionally, in one preferred embodiment, the apparatus includes means for measuring a length of hose, as a length of hose passes the measuring or counting device or mechanism. Such "counters", as they are sometimes called, are conventional. For example, one such counter is made by Olympic, a company believed to be incorporated in the state of Washington.

The present invention further concerns a system for automatically cutting a length of hose into pieces of desired specified lengths. The system has a hose input end and an opposite hose output end. Between the input end and the output end extends a hose pathway through which a hose to be cut is guided. The system includes means for feeding hose through the pathway; means or structure for measuring the hose length as a hose passes thereby; and means for cutting the hose at a specified position along the length of the hose. The system further includes means or structure for supporting the hose located between the measuring means or structure or device and the cutting means or structure or device. The supporting means or structure holds a portion of the hose substantially linear as it passes from the measuring device to the cutting means or structure. The system further includes means or structure for bending a portion of the hose such that during cutting, the portion of the hose located between the cutting edge and the output end is displaced as the cutting edge passes through the hose. This is done in such a manner that the second portion of the hose is pulled away from the cutting blade as it cuts. In this manner, binding of the blade as it passes through the hose is avoided. That is, the second portion of the hose is peeled away or moved out of the path of the cutting blade as the cutting blade cuts through the hose.

The present invention further concerns a method for cutting hose including the steps of providing cutting structure, measuring structure, and bending structure as described above, moving the hose from a first position in which its terminating end is located aligned with the measuring device, to a second position in which the terminating end is past the blade a desired amount. That is, the distance from the cutting edge to the terminating end is the desired length of the hose piece to be cut. The method then involves the step of moving the cutting blade through the hose, while simultaneously operating the bending means to cause a portion of the hose adjacent the cutting blade on the trailing side thereof, to peel away from, or be moved out of the way of, the cutting blade. Still further, the method involves a step of supporting a portion of the hose adjacent the cutting blade on the leading side thereof, to maintain the axis of this portion of the hose in a substantially co-linear relationship with the portion of the hose extending between the measuring device and the cutting blade. That is, the method involves a step of preventing the hose from bending between the measuring device and the leading edge of the cutting edge. In this manner, accuracy can be achieved as to the length of the desired piece to be cut.

Devices are known which employ a circular saw blade to cut through hose. In such arrangements, typically, the blade is double-beveled. That is, both the leading side and the trailing side of the cutting blade have a bevel. To avoid binding during cutting with such a blade, typical conventional arrangements require that the hose be bent away from both bevels, or both sides of, the saw blade. This is disadvantageous, because the length of the measured portion is inaccurate, due to the bending down-line measurement, but up-line from cutting. That is, certain sorts of hoses, and cables, including hydraulic hose, stretch to some extent when they are bent. Thus, when the portion of the hose between the counting device and the cutting edge is bent, the measurement therebetween (as measured by the counter) is likely to be inaccurate. In contrast, the present apparatus, system and method maintains a linear, unbended, orientation of the cable or hose between the counting device and the saw blade, thereby increasing the accuracy of the length of the piece measured.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings, in which like reference numerals indicate corresponding parts through several views.

FIG. 4*a* is a cross-sectional, enlarged, fragmentary view of a portion of a circular saw blade for use with an apparatus and system according to the present invention;

FIGS. 9*a, b,* and *c* are schematic side elevational views depicting the process of cutting with an apparatus and system according to the present invention;

FIGS. 10*a, b,* and *c* are schematic side views depicting the cutting process with a prior art arrangement;

DETAILED DESCRIPTION OF THE PREFERRED EMBODIMENTS

Figure 1:
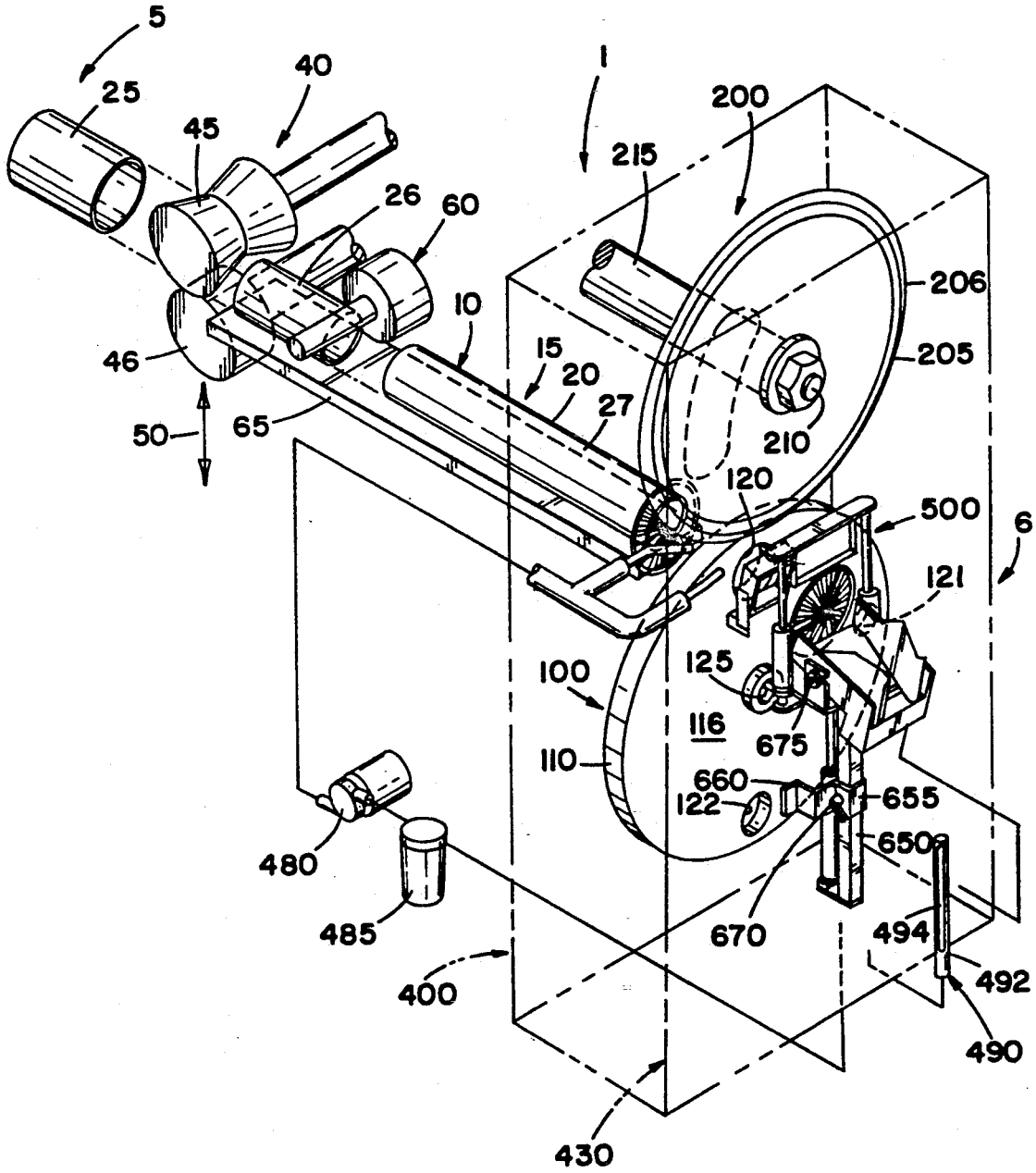
FIG. 1 is a perspective view generally from the output end looking toward the input end, of an apparatus and system according to the present invention, with hidden portions indicated by dashed lines, and with portions not illustrated indicated in phantom lines.

As required, detailed embodiments of the present invention are disclosed herein. However, it is to be understood that the disclosed embodiments are merely exemplary of the invention, which may be embodied in various forms. Therefore, specific structural and functional detail disclosed herein are not to be interpreted as limiting, but rather as a basis for the claims and as a representative basis for teaching one skilled in the art to variously employ the present invention in virtually appropriately detailed structure. A preferred embodiment of the apparatus and system according to the present invention is illustrated in FIG. 1. This discussion will follow the drawing generally from the left-hand side to the right-hand side of the drawing, the direction in which a hose would pass through the apparatus in typical use.

Throughout this description, directions such as left, right, up, down, horizontal, vertical, and so forth are used for convenience with respect to the orientation of the apparatus illustrated in the FIGURES. Such terms are used for convenient reference only, and are not to be considered or interpreted to be limiting or substantive.

The hose cutting apparatus 1 has an input end 5 and an opposite output end 6. Input end 5 is generally located at the left-hand side of FIG. 1 and output end 6 is generally located at the right-hand side of FIG. 1, respectively. A hose pathway 10 extends between input and output ends for passage of the hose to be cut therethrough. This pathway 10 is defined by guide means 15 which incorporates guide members 20 such as generally cylindrical conduits 25, 26, and 27, as well as a number of other features located along the pathway 10 which will be discussed in greater detail below. (Examples of these will be feeding structure, a measuring structure, a cutting zone, supporting structure, and an exit support structure.)

Located proximate the input end 5, is a feeding structure 40 in the preferred embodiment. It is to be understood that the feeding structure in the embodiment illustrated is incorporated into the apparatus. It may, however, within the spirit of this invention be an entirely separate unit, commercially available. In some applications of the apparatus of the present invention, it will be understood that no hose-feeding or pulling device is required. The feeding structure 40 pulls or feeds cable or hose from, for example, a spool-type storage device, into and through the apparatus. The feeding structure 40 in general terms includes an upper feeding spool or member 45, and a lower feeding spool or member 46. Preferably, one or both of the spools are shaped to guide a hose along pathway 10. In other words, the feeding structure 40 is located along the pathway 10, and is disposed and operated to feed a hose along pathway 10. In the embodiment illustrated, the lower feeding spool 46 is movable vertically, as illustrated by arrow 50. This allows the space between upper and lower spools 45 and 46 to be adjusted to accommodate hoses of different diameters.

Moving further to the output end 6, is a measuring device or structure 60. Measuring devices are commercially available. For instance, a typical measuring device is called a "counter" or "counting wheel". As hose passes by the counting wheel, the counting wheel measures the length of the hose passing thereunder or therethrough, and, in a preferred embodiment, passes this information to electrical controls which will be described below.

Guide 26 extends between the feeding structure and the counting structure. A support member 65 extends along a portion of the pathway 10 and, in the area below the measuring device 60, acts to support the hose as it passes under the measuring device 60.

Next, from input to output end along pathway 10, is structure 100 for supporting a hose as it approaches the cutting structure 200. In the embodiment illustrated in the FIGURES, the support structure includes die or die member 110. Die member 110, in the embodiment illustrated, is a generally cylindrical or disc-shaped member having a first face 115 (not visible in FIG. 1) that faces the input end 5, and a second face 116 (visible in FIG. 1) which generally faces the output end 6. In a preferred embodiment, faces 115 and 116 are generally substantially parallel. Die member 110 has one or more apertures therethrough. In the embodiment illustrated in FIG. 1, three apertures 120, 121, and 122 pass through die member 110, or extend between faces 115 and 116. Apertures 120, 121, and 122 are preferably of different diameters to accomodate hoses of different diameters. It is generally preferable for the aperture to be larger than the outside diameter of the hose by a relatively small amount. Die member 110 is mounted through its axis 125 to a shaft 126 mounted in some conventional manner to allow die member 110 to rotate on the shaft 126, preferably about axis 125. In use, the user rotates die member 110 such that the aperture 120, 121, or 122 having the appropriate diameter for use with the hose to be cut is positioned along pathway 10. In the orientation illustrated in FIG. 1, aperture 120 is in communication with pathway 10, such that a hose as it passes between input end 5 and output end 6 will pass through aperture 120.

Figure 5:
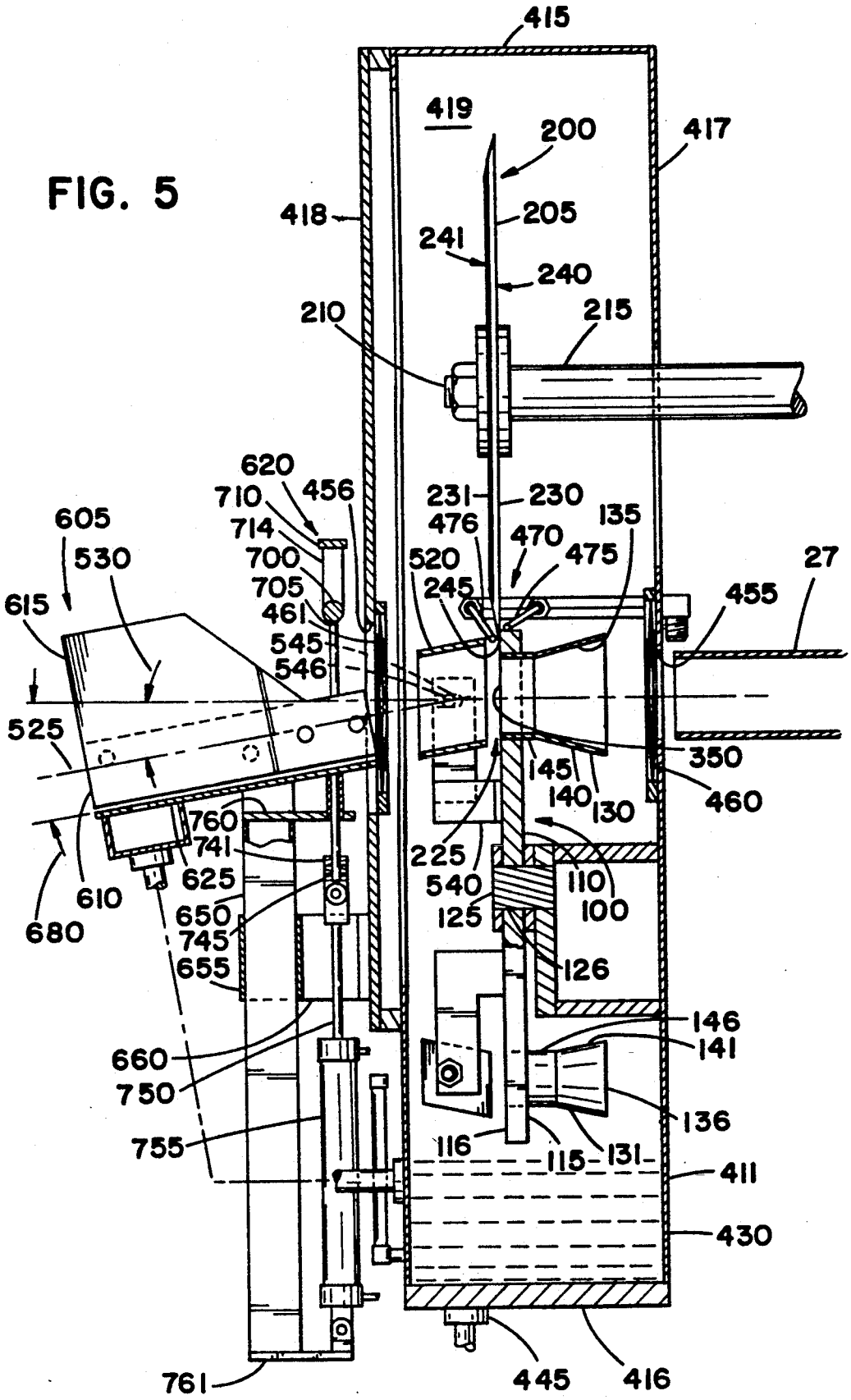
FIG. 5 is a cross-sectional view taken along line 5—5 in FIG. 2; the view is fragmentary and enlarged; the view shows the cutting structure, supporting structure, bending structure and various other features of an embodiment of the apparatus and system of the present invention.

Turning to FIG. 5, die member 110 is seen in cross-section. As can be seen from FIG. 5, extension members or extension guides 130 and 131 extend from first face 115 towards the input end 5. Extension member 130 cooperates with aperture 120 through die member 110, and extension member 131 cooperates with aperture 122 and die member 110. More specifically, extension members 130 and 131 each are generally tubular members having apertures or passages 135 and 136, respectively, therethrough. In the preferred embodiment illustrated, each of the extension members 130 and 131 include a frusto-conical shaped portion 140 and 141, respectively, and a generally cylindrical portion 145 and 146, respectively, extending into apertures 120 and 122, respectively.

The diameter of apertures 120, 121, and 122, and of passages 135 and 136 are selected to be slightly larger than the outer diameter of the hose to be cut, so that the hose will be adequately supported by the die member 10 as the hose is cut. In a preferred embodiment, an aperture 120, 121 or 122 is chosen which is between about $\frac{1}{8}$ inch to $\frac{3}{4}$ inch larger in diameter than the hose that is to be cut.

Turning again for reference to FIG. 1, cutting structure 200 is illustrated. As can be seen from FIG. 1, the cutting structure 200 in the preferred embodiment illustrated is a circular, toothless blade 205. The blade 205 is mounted at its axis 210 to a shaft 215 by conventional methods for rotation about its axis 210. Additionally, shaft 215 is moveable along a substantially verticle path. This movement along a substantially verticle path of shaft 215, allows the circular blade 205 to move along a path from a first, upward, position in which a hose, uncut, is located therebelow in a cutting zone 225, to a second lowered position in which the cutting edge of cutting blade has passed through the diameter of the hose to be cut. This path in the verticle direction proscribed by the cutting edge is the cutting path. This will be better understood with reference to certain of the other FIGURES. For example, FIG. 5 illustrates circular blade 205, blade axis 210, shaft 215, and the cutting zone 225 in cross-sectional side view. As can be further seen from FIG. 5, circular blade has a front face 230 facing input end 5. Generally, the cutting structure 200 divides the apparatus into two halves: a first leading side 240 and a trailing side 241. The space to the right of face 230 is the leading side 140 of circular blade 205; the space to the left of face 231 is the trailing side of cutting means 200. The terms "leading side" and "trailing side" will be used for convenient reference for placement of various things with respect to the cutting structure 200.

In the embodiment illustrated in FIG. 5, the circular blade 205 terminates in a cutting edge 245 about its periphery. In this embodiment, the cutting edge 245 is located along the terminal edge of face 230.

As can be better seen with reference to FIG. 4*a*, which shows circular cutting blade 205 in fragmentary cross-section and greatly enlarged, the peripheral edge 206 of circular blade 205 includes two beveled portions. That is, a first portion 250 has a side or face 251 which defines an angle with the plane in which face 230 lies. In the embodiment illustrated, a second beveled portion 255 has a side or face 256 which forms an angle 257 with the plane in which face 230 lies. Angle 252 is preferably greater than angle 257. In a preferred embodiment, angle 252 is between about 5°–15°, and angle 257 is between about 4°–12°. Both bevel faces 251 and 256 are on the trailing side of cutting blade 205. It is to be understood that the second bevelled portion 255 is not required to achieve a relatively high quality cut.

Figure 4B:
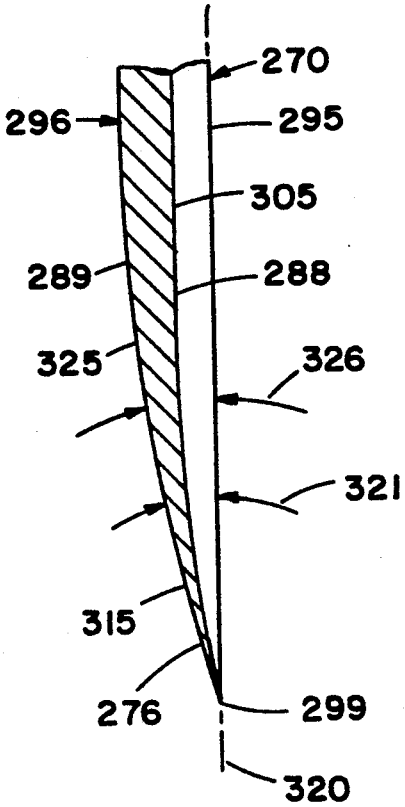
FIG. 4*b* is an enlarged, cross-sectional, fragmentary view of an alternate embodiment of a portion of a saw blade for use with an apparatus and system according to the present invention.

An alternate embodiment for circular blade 205 is a hollow-ground circular saw blade 270. Such a blade is illustrated in FIG. 4*b* in enlarged, fragmentary, cross-illustrated section. Blade 270 has a peripheral edge portion 276. Circular blade 270 would be mounted on its axis (not shown) on a shaft (not shown) in a manner similar to that described above with respect to circular blade 205. Hollow ground blade 270 has a first face 288 generally facing toward the input side of the apparatus and a second face 289 generally facing toward the output end of the apparatus. The leading side 295 of blade 270 is directed toward the input end 5, and the trailing side 296 is directed toward the output end 6. The peripheral edge portion 276 terminals in a cutting edge 299. Blade 270 is termed a "hollow-ground" blade because of the hollowed portion 305 on its leading face. The peripheral edge 276 of the trailing face 289 is generally similar to the blade 205, in that it includes a double bevel. Portion 315 and the defined by the cutting edge 299 define an angle 321 therebetween. Similarly, a second beveled portion 325 and line 320 define an angle 326 therebetween. Angle 321 is slightly larger than angle 326 in a preferred embodiment. Angle 321 is preferably between about 5°-15°; angle 326 is preferably between about 4°-12°.

As will be described in greater detail below, angles 252 and 257 in the embodiment illustrated in FIG. 4*a*, and angles 321 and 326 in the embodiment illustrated in FIG. 4*b*, are dependent upon or are proportional or related to the angle of an exit die member axis. This relationship between the angles aids in obtaining a quality cut, as will be described further below.

The path defined by cutting edge 245 or 299 as the cutting structure 200 is moved vertically downward through the cutting zone is the cutting path 350. Thus, to obtain a cut in a hose at a desired position, that desired position is positioned within the cutting path.

It will be understood with reference to FIG. 5 that the distance between the leading face of the cutting blade and the second face 116 of die member 110 is relatively small in a preferred embodiment, so that the hose is firmly supported at a portion immediately adjacent the cutting blade.

Figure 7:
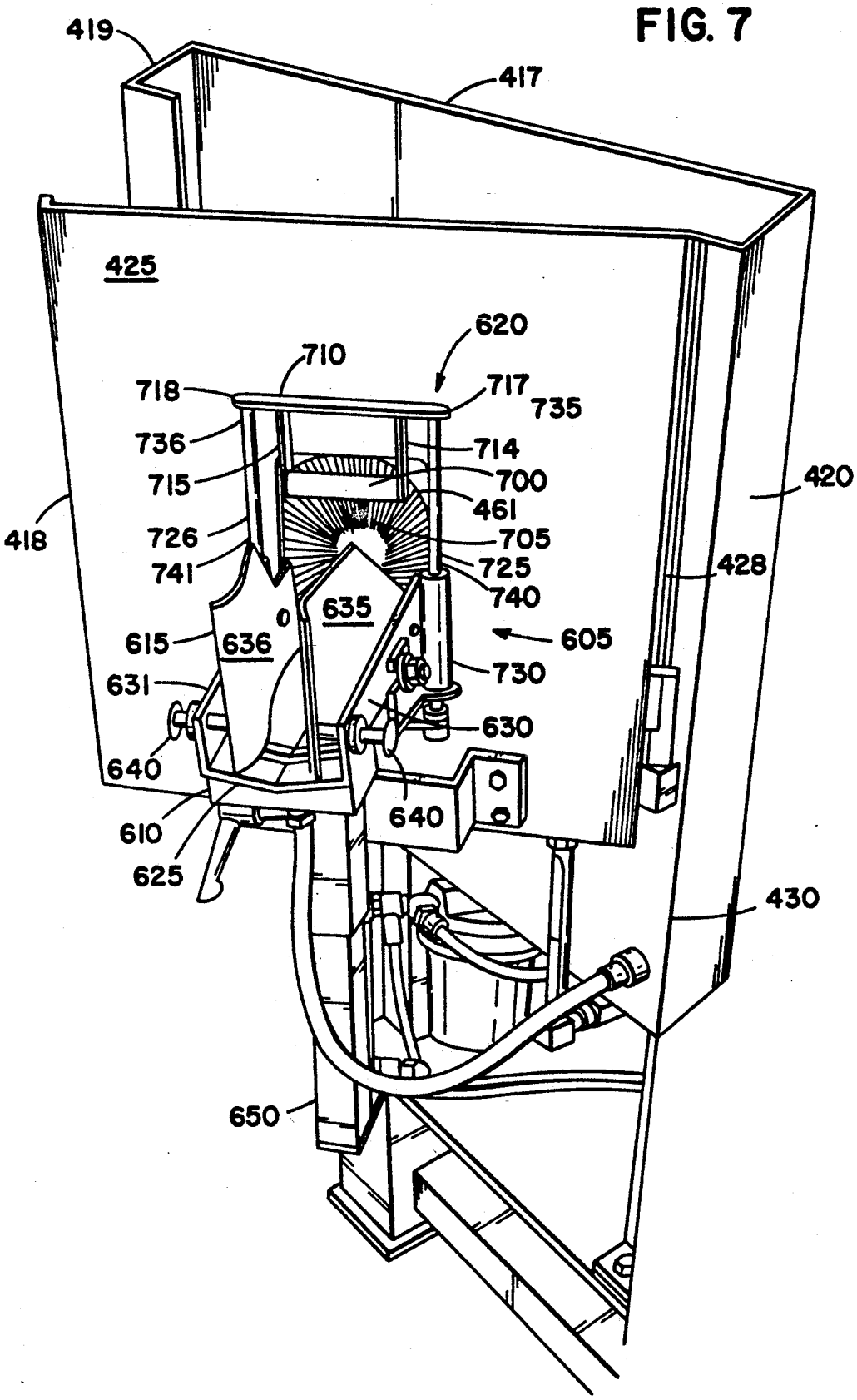
FIG. 7 shows a perspective view of a portion of the output end and bending structure and various other features of an apparatus according to the present invention.
Figure 8:
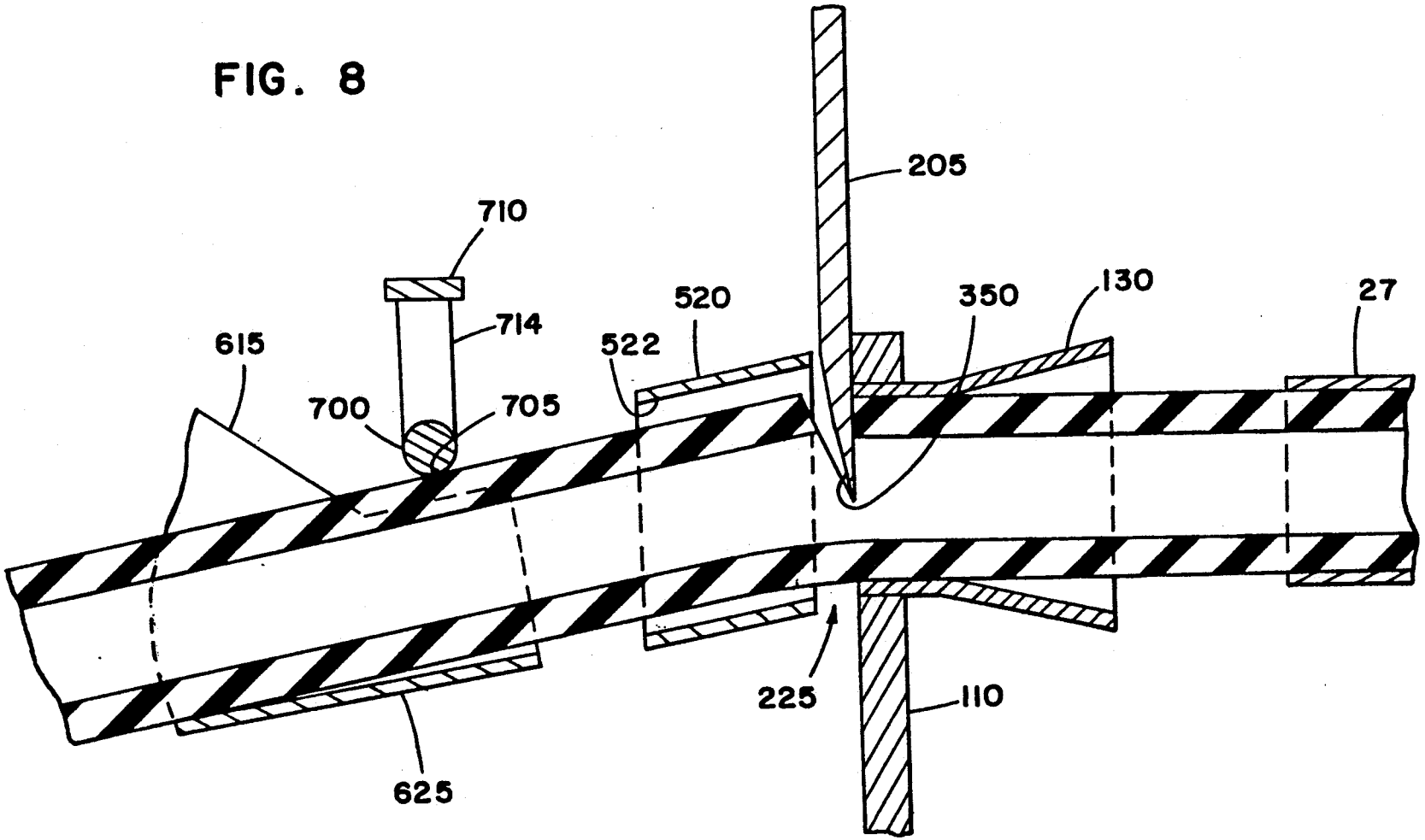
FIG. 8 is a schematic, enlarged, fragmentary, cross-sectional view of a portion of the apparatus and system of the present invention, with a piece of hose located therein during cutting.
Figure 13:
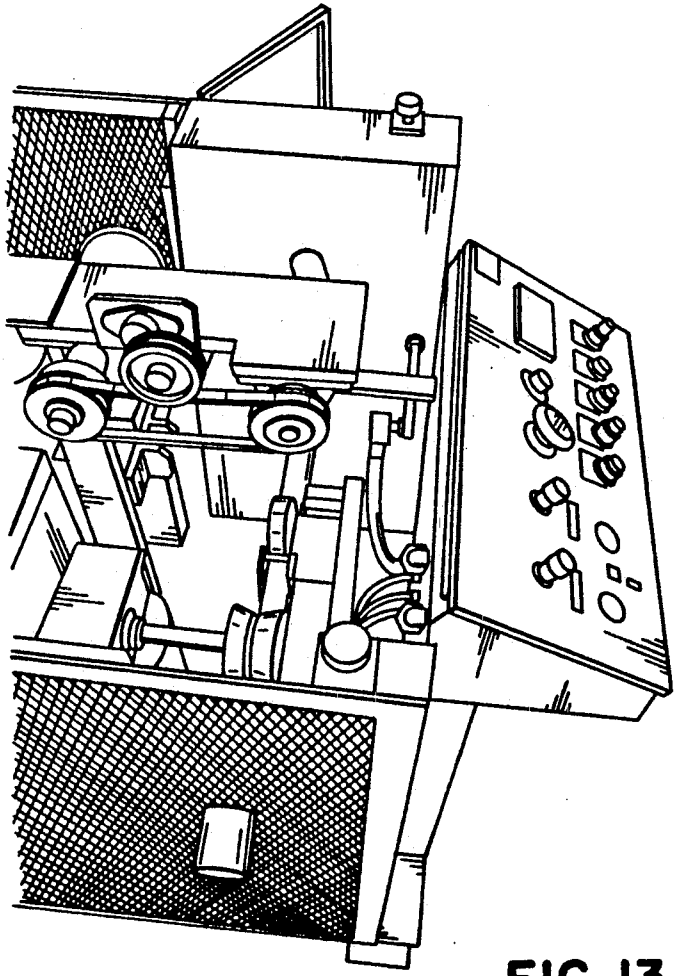
FIG. 13 is a perspective view from the top of a machine incorporating an apparatus according to the present invention.
Figure 12:
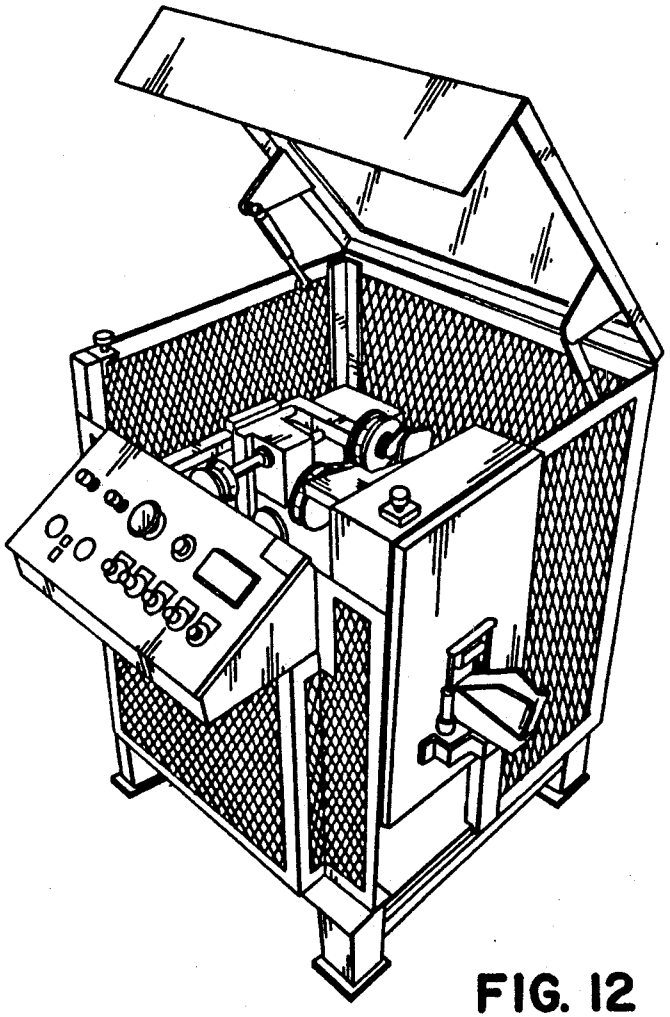
FIG. 12 is a perspective view from the right side of a machine incorporating the apparatus of the present invention.
Figure 14:
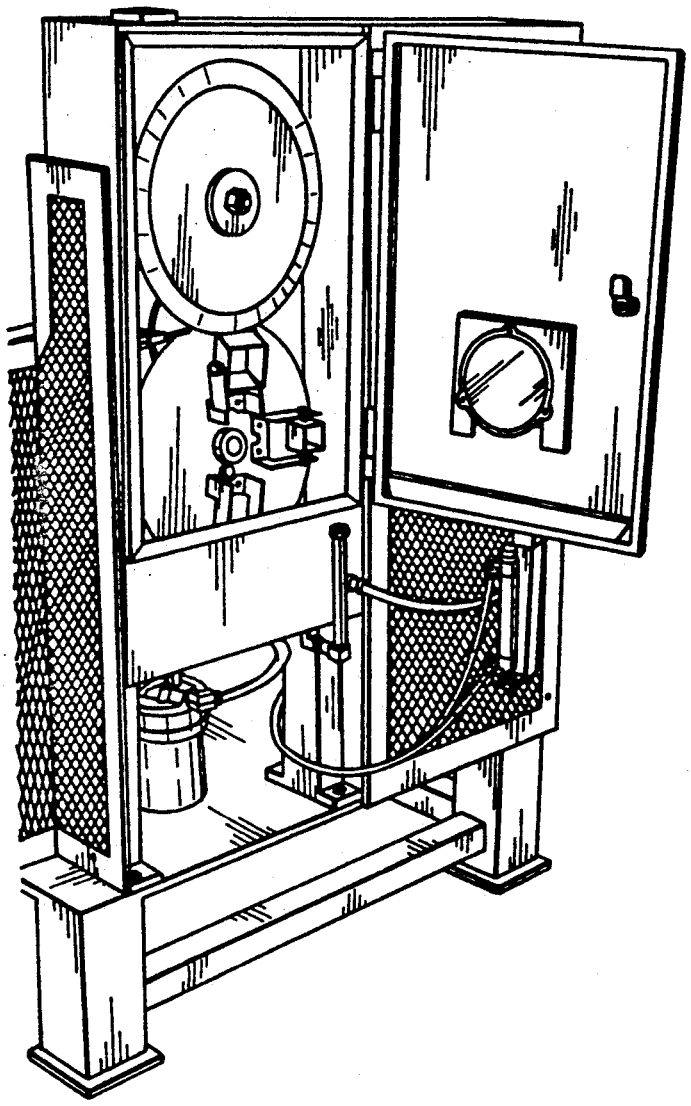
FIG. 14 is a fragmentary perspective side view of a portion of a machine incorporating an apparatus according to the present invention.
Figure 15:
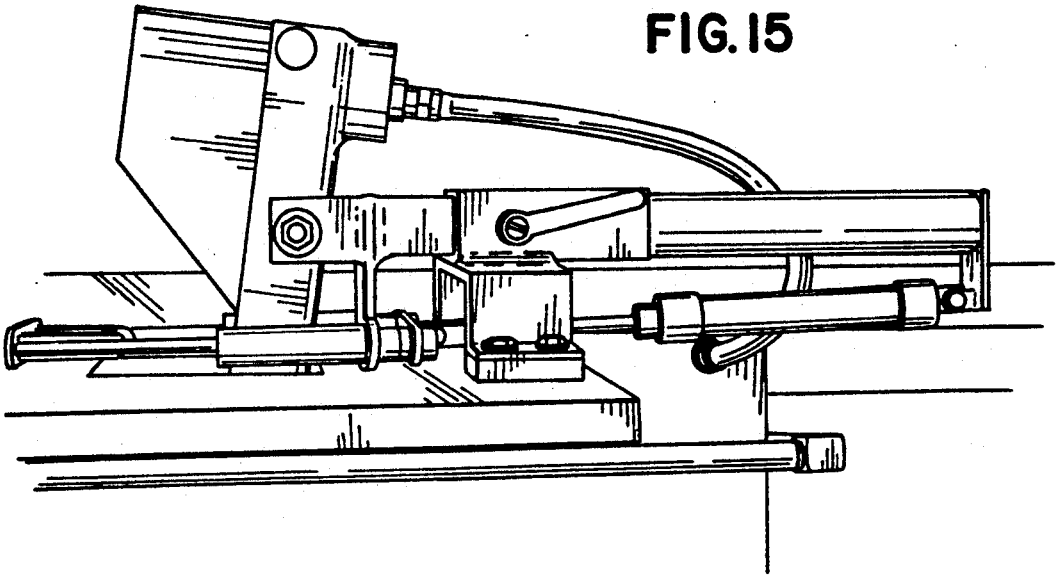
FIG. 15 is a fragmentary elevated side view of a portion of a machine incorporating an apparatus according to the present invention.

In a preferred embodiment, the cutting structure 200 and the support structure 100 are located within an enclosure 400. This enclosure 400 is illustrated as a generally rectangular box 410 in the embodiment illustrated in the FIGURES. This box is further illustrated in phantom lines in FIG. 1. The box is illustrated in cross-section in FIG. 5. The box 410 has a top wall 415, a bottom wall 416, a leading-side side wall 417, a trailing-side side wall 418, a front wall 419 (illustrated in FIG. 1 in phantom), and a back wall 420 visible, for instance, in FIG. 7. Rectangular box 410 has a door 425 hingedly attached at one edge 428 to back wall 420. This is best illustrated in FIG. 7. A further portion of trailing-side side wall 418, illustrated at numeral 430, is the bottom portion of side wall 418 that forms a portion of the box but is not included in the door 425. The bottom portion 411 of the box 410 defines a reservoir 440 for liquid, with an outlet 445 at the bottom thereof.

Figure 6:
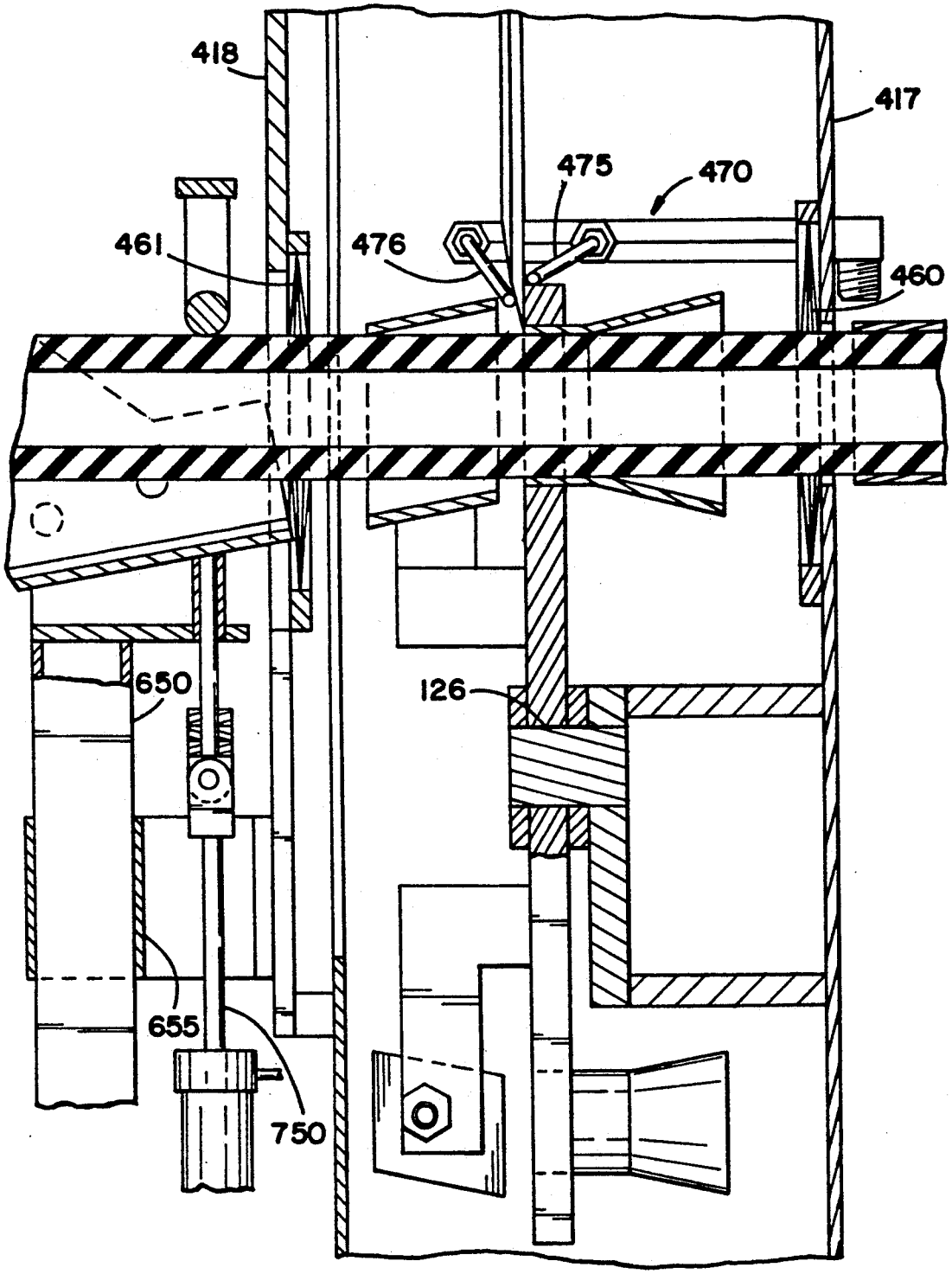
FIG. 6 is a cross-sectional, enlarged, fragmentary view of a portion of the structure illustrated in FIG. 5, with a hose to be cut being located therein.

Additionally, rectangular box 410 has apertures 455 and 456 in leading-side side wall 417 and trailing-side side wall 418, respectively. These apertures lie along and partially define pathway 10. Apertures 455 and 456 are provided with brushes 460 and 461, respectively, which are attached to the peripheral edges of apertures 455 and 456 and which are directed radially inward. These brushes are visible in FIG. 6 as well.

Again with reference to FIG. 5, the preferred embodiment of the present invention includes spraying structure 470. Spraying structure 470 allows for a liquid to be sprayed on and near the cutting edge of the cutting blade 200 as it cuts through a hose. More specifically, spraying structure 470 includes nozzles or spray devices for directing fluid flow toward the blade 200. These spraying devices are indicated at reference numerals 475 and 476. In the embodiment illustrated, nozzle device 475 is located on the leading side of blade 205; nozzle device 476 is located on the trailing side of blade 205.

Turning to FIG. 1, the circulation of fluid will be understood. In use, fluid, preferably a non-rusting or corrosive-resistant liquid, is placed in the reservoir 440. Fluid will be pumped from reservoir 440 to nozzle devices 475 and 476 by a pump 480. A filter 485 is preferably disposed in fluid communication between the reservoir 440 and pump 480 to filter impurities from the liquid. A gauge 490 for determining the level of liquid in the reservoir 440 is provided in fluid communication with reservoir 440. In the embodiment illustrated, gauge 490 is a sight gauge 492 located with an indicator or see-through portion 494 located generally proximate the bottom portion 411 of box 410 and in fluid communication therewith. The level of liquid visable in gauge 492 is the level of liquid within reservoir 440.

Spraying a liquid on the cutting blade 205 as it moves through the cutting path is advantageous, because it cools the cutting blade 205 as it cuts through the hose. Thus, when cutting hose that is susceptible to melting due to increased temperatures resulting from the cutting process, the blade is maintained at a relatively cool temperature to prevent or reduce the tendency of the hose to melt. As discussed about, when hose melting during cutting, rubber or other melted materials tend to be deposited on the cutting blade 205, causing the blade to become less effective at achieving a quality cut, and shortening the useful life of the blade. Further, the liquid lubricates the cutting blade to further enhance the quality of the resulting cut. Additionally, the spray is helpful in carrying away particles or dust resulting from the cutting process.

The portion of the support structure located to the leading side of cutting blade 205 has been described above. Additional support structure is located on the trailing side of blade 205. This structure will be identified as the "bending structure" 500, but it is to be understood that the bending structure performs the function of bending a portion of the hose, as will be described, as well as supporting that portion of the hose.

With reference to FIG. 5, it will be understood that the bending structure is in two sections 505 and 506. Section 605 will be described below. With reference to FIG. 3, the first section 505 is a first guideway or exit die member 510 mounted by conventional means, such as a bracket, to die member 110. In fact, a different guideway is provided in cooperation with each of apertures 120, 121, and 122 of die member 110. Thus, guideway 510 corresponds to aperture 120. Second guideway or exit die member 515 corresponds to aperture 122. Third guideway or exit die member 517 is provided in cooperation with aperture 121, and is partially visible in FIG. 2. Referring again to FIG. 5, the structure of a guideway 510 is described. It should be understood that guideways 515 and 517 are substantially similar.

Guideway 510 includes a passage-defining member 520. In the embodiment illustrated, passage-defining member 520 is generally square or rectangular, defining a square or rectangular passage or conduit 522 therethrough. This is visible from FIG. 1. In the preferred orientation, passage 522 has an axis 525 therethrough which is inclined at an angle to an axis through aperture 120 and passages 135 and 136 through extension members 120 and 122. This angle is identified at reference numeral 530. (In the orientation shown, axis through aperture 120 is generally horizontal. In fact, the longitudinal axis of pathway 10 from the input end 5 of the apparatus 1 to the leading face of cutting blade 200 is linear and generally horizontal. The axis of the pathway 10 from the trailing edge of cutting blade 205 and the output end 6 of the apparatus is generally disposed at an angle thereto, although this will be described in greater detail below.)

The guideway passage 522 is defined by support surfaces 532, 533, 534, and 535, which in the embodiment illustrated are each generally planar and are generally perpendicular to adjacent support surfaces. Preferably top and bottom surfaces 532 and 533 are spaced a distance apart that is slightly larger than the outer diameter of the hose to be cut. In other words, the distances between top and bottom supporting surfaces of the cooperating exit die member are generally between about ⅛ and ¾ inches larger than the cooperating aperture 120, 121, or 122. In use, an appropriate aperture and exit die member are chosen based upon the outer diameter of the hose to be cut, such that the hose will be received within and supported by the wall defining the aperture by the support surfaces of the exit die member. In this manner, the exit die member directs the hose downward as it passes therethrough, while simultaneously supporting the hose from beneath to prevent it from bending downwardly an excessive, undesired amount, for example as a result of the force exerted downwardly by the cutting blade. As a result, the hose to the trailing side of the cutting blade 205 is maintained at an angle with respect to the plane of the cutting edge such that a particularly square or accurate cut can be achieved. In a preferred embodiment, the axis 525 of the die member passage 522 is approximately equal, within about 0 to 15 degrees, to the angle 252 of the first bevelled portion of the cutting blade.

Guideway 510 is attached to die member 110 by a bracket arrangement 540. Bracket arrangement 540 includes structure 545 for adjusting the distance between guideway 510 and the second face 116 of die member 110. Distance adjusting structure 545 in the embodiment illustrated includes a slot 550 in a portion of the bracket and a pin 551 that is slidably recieved in the slot. The pin is located on member 520. Additionally, guideway 510 includes structure 546 for adjusting the angular position of axis 525 by pivoting passage-defining member 520 about sliding pin joint 550.

Turning now to the second section 605 of bending structure 500, with reference to FIG. 5, it will be understood that second section 605 includes a supporting base 610; structure 615 for lateral positioning of a hose on base 610; and structure 620 for pressing downwardly on the top surface of a hose.

More specifically, a preferred embodiment includes a base plate 625, with sidewalls at the edges thereof extending upwardly. The sidewalls are indicated as reference numerals 630 and 631, and are best illustrated in FIGS. 1 and 7.

Structure 615 for laterally positioning a hose resting on base plate 625 includes two contoured walls 635 and 636 located generally on opposite sides of base plate 625, but within side walls 630 and 631. This is illustrated in FIG. 1, for instance. In the preferred embodiment illustrates, contoured walls 635 and 636 are somewhat flexible. Additionally, means, such as screws 640, as illustrated in FIG. 7, are provided to be selectively adjust the distance between contoured walls, such that the walls receive a hose therebetween relatively snugly. For example, screws can be used which can be turned to squeeze contoured walls 635 and 636 inwardly to the desired spacing.

Second section 605 of bending structure 500 is illustrated in FIG. 7 in perspective. Supporting base 610 is mounted, in the embodiment illustrated, to box 410 by various brackets as illustrated in FIG. 5. More particularly, extending downwardly from supporting base 610 is a support shaft 650. Support shaft 650 is slidable in a vertical direction within a sleeve 655 that is attached by a bracket 660, such as by welding or other conventional means, to door 425 of box 410. This bracket 660 is visible in FIG. 1. That is, the height of base plate 610 can be adjusted to accommodate hoses of various diameters. In the embodiment illustrated, a handle 670 is supplied to extend through sleeve 655 and engage shaft 650 to selectively secure shaft 650 at the desired height position. In addition, supporting base 610 can be pivoted about an axis through screws or the like at reference numeral 675 as illustrated in FIG. 1. In this manner, the angle of inclination 680 of supporting base 610 can be adjusted.

Preferably, the angle 530 (defined by the axis of guideway 510) is substantially similar to the angle 680 of the base plate. At least, these angles preferably are correlated in an advantageous manner.

The bending structure 620 is illustrated in FIGS. 5 and 7. With reference to FIG. 7, it will be understood that bending structure 620 includes a hold-down member 700. The hold-down member has a lower surface 705 which, when in use, contacts the top surface of a portion of a hose, thereby pressing down on that portion of the hose. Hold-down member 700 is suspended from crossbar 710 by legs 714 and 715. Crossbar member 710 has first and second opposite ends 717 and 718. Extending downwardly from ends 717 and 718 are rods 725 and 726, respectively. Bushing Sleeves 730 and 731 (sleeve 730 is visible in FIG. 7 and sleeve 731 is visible in FIG. 1) receive rods 725 and 726 for sliding movement therein.

Turning to FIG. 5, it will be understood that the rods 725 and 726 are connected at first upper ends 735 and 736, respectively, to ends 717 and 718 of crossbar 710, respectively. At second opposite ends (the lower ends) 740 and 741, rods 725 and 726 are attached to a lower crossbar 745. Generally, at the center of lower crossbar 745, lower crossbar 745 is attached to another downwardly extending rod 750 which is slidably received in another sleeve 755. When activated by a solenoid, lower rod 750 is retracted downwardly into sleeve 755. Accordingly, lower crossbar 745 moves downwardly, pulling with it rods 725 and 726 into bushing sleeves 730 and 731. In this manner, upon activation of a solenoid, hold-down member lower surface 705 is selectively moved downwardly to press against the top portion of a portion of a hose.

Supporting base 610 includes structure for allowing drainage of liquid from the supporting base 610 to reservoir 440. This is advantageous since brushes 456 may allow some liquid to leak pass out of the box as the hose passes therethrough. Therefore the drainage at the bottom portion of the supporting base 610 allows for that liquid to return to that reservoir 440.

Brackets 760 and 761 extend between a portion of support shaft 650 and sleeves 730 and 731. The opposite lower end of support shaft 750 is fixed to the lower end of sleeve 755. In this manner, as support shaft 650 is adjusted upwardly or downwardly, the hold-down structure moves therewith.

Figure 2:
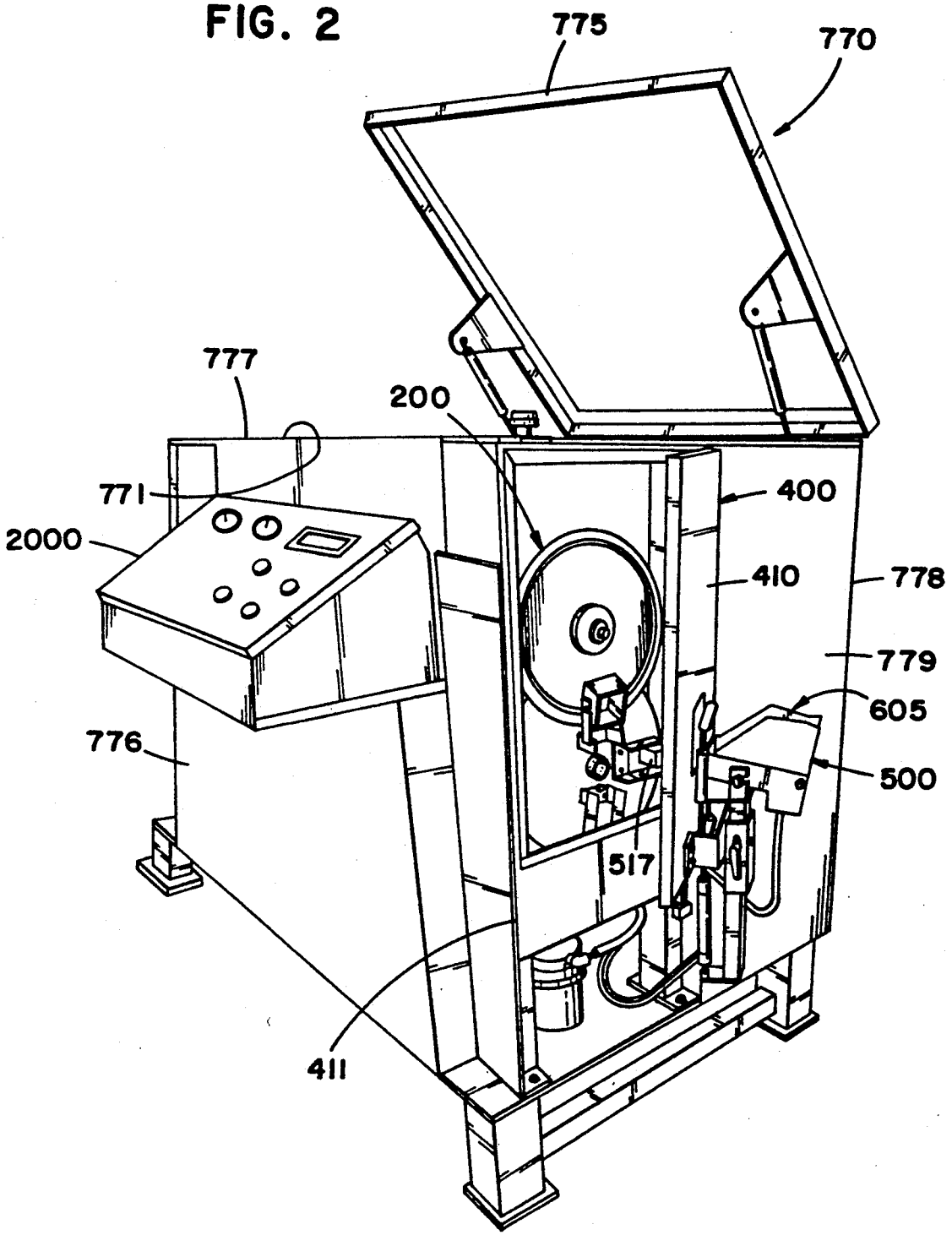
FIG. 2 is a perspective view of a machine incorporating the apparatus and system of the present invention.
Figure 3:
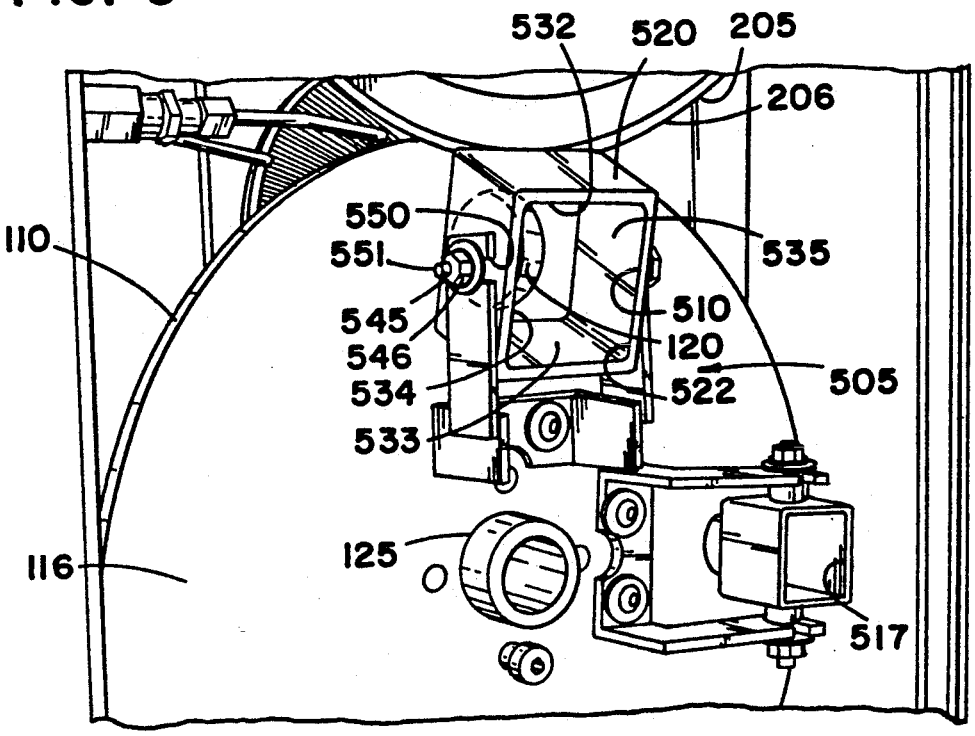
FIG. 3 is an enlarged, perspective, fragmentary view of a portion of the cutting structure, supporting structure, and various other features of the apparatus and system according to the present invention.

For convenient use, it is advantageous for the apparatus to be enclosed within a housing structure, as illustrated in FIG. 2. Housing structure 770 preferably defines a cavity 771, and has a hinged lid 775 to allow convenient access to the internal apparatus, i.e., the hose-cutting apparatus 1 described above.

In the embodiment illustrated, the housing structure is generally box-like, having four side walls 776, 777, 778, and 779. The four sides 776–779 are preferably made substantially of expanded metal, to allow adequate ventilation of the system while providing protection against any flying debris or other foreign matter which might injure a person standing nearby. Lid 775 advantageously includes a transparent lid pane to allow viewing of the internal workings of the apparatus. Most preferably, the lid is of a bulletproof glass to guard against flying debris and/or broken cutting blade portions.

Turning to schematic FIGS. 9A–C and 10A–C, a process for cutting a desired length of hose is described. FIGS. 9A–C depict one embodiment of an arrangement according to the invention described herein. FIGS. 10A–C depict a prior art arrangement. It should be understood that FIGS. 9A–C depict an embodiment of an apparatus that includes various features that have been described above. It is not intended the features depicted therein are necessarily essential features of an apparatus of system according to this invention.

Turning to FIG. 9A, a measuring device is schematically illustrated at reference numeral 1000. A hose to be cut is illustrated at reference numeral 1005. The guiding means is illustrated schematically at reference numeral 1010, and the cutting blade is illustrated schematically at 1015. To begin, a piece of hose having a terminating end 1006 is fed into the position illustrated in FIG. 9*a*. The distance between counter 1000 and terminating end 1006, where the terminating end 1006 is at the saw blade 1015, is indicated by distance $l_1$. Counter 1000 will have measure distance $l_1$ as terminating 1006 passed from counter 1000 to the position illustrated in FIG. 9*a*. Next, as the hose is continued to be fed through the apparatus, hose 1005 will reach the position illustrated schematically in FIG. 9*b*. At this position, the measuring device 1000 will have determined that the desired length $l_2$ is located past the saw blade 1015. In this position, hose 1005 includes two portions: portion 1005*a* has a length $l_2$ that is the length desired for the hose piece that is to be cut. It extends from saw blade 1015 to terminating end 1006. Portion 1005*b* of hose 1005 has length $l_1$ which is the distance between the measuring device 1000 and the leading edge of the cutting blade 1015.

The next step in the cutting process is illustrated schematically in FIG. 9*c*. The saw blade and hold-down member 1020 are signalled to move downwardly. As the saw blade cuts through the hose, hold-down member 1020 pushes down on hose portion 1005*a*, causing it to bend away from or peel away from, hose portion 1005*b*. In this manner, hose portion 1005*a* creates clearance for saw blade 1015 to continue its journey downward, thus preventing binding.

Further, this process allows for accurate measurement of distance $l_2$.

A prior art cutting process is illustrated in FIG. 10, schematically. Steps A and B are substantially similar to those illustrated in FIG. 9A and 9B. The structures that are analogous to those illustrated in FIGS. 9A–9C are given the same reference number, with a prime (′) added. For example, a measuring device is indicated by reference number 1000′; a hose portion is indicated by 1005′; a blade is indicated by 1015′; the distance between counter 1000 prime and its terminating end 1006′, where the terminating end 1006′ is at the saw blade 1015′, as illustrated in FIG. 10A, is indicated by distance $l'_1$; and length $l_2'$ is the length that extends from saw blade 1015′ to terminating end 1006′ when the hose is in the desired position for cutting, as illustrated in FIG. 10B. In FIG. 10*c*, however, a difference between the process of the present invention and the prior art process is illustrated. Because prior art saw blades are beveled on both the leading and trailing sides, it is necessary to bend both hose portions 1005*c* and 1005*d* to prevent binding. Various structures have been employed to effect this dual bending. One such arrangement applies force, for example at arrows 1030. Hose 1005′ is then bent over support members 1040 and 1041. Because the portion of hose 1005*d* immediately before the cutting blade, was bent, it was slightly stretched. The result was that the measurement of the desired hose pieces was inaccurate.

The system of the present invention allows for automatic and selective control of the number of pieces of hose to be cut having the length desired. By entering the desired length and number of pieces into the appropriate controls in an electronic control box 2000, illustrated in FIG. 2, and through conventional methods of circuitry, signals are sent to the saw blade, to the hold-down member, the counting means, and the spraying means, such that when the desired length of hose is properly positioned, the saw blade and the hold-down member simultaneously are depressed and the spray is ejected at the saw blade. If the user has chosen more than one hose piece to be cut, the feeding means will continue to feed hose into the system, the measuring device will allow feeding until the desired length is properly position, feeding will stop, and the saw blade hose member and spray will activate. This process will repeat until the desired number of pieces have been cut.

This invention also relates to a method of cutting hose pieces including the steps of a method of cutting hose having a longitudinal axis and terminating at one free end portion, comprising the steps of: providing cutting means for severing a hose generally across its diameter at a selected position along its length; said cutting means having a leading side and an opposite trailing side; providing means for measuring hose length as hose passes said measuring means with the axis thereof lying along a first line; positioning said measuring means at a position spaced from said cutting means, proximate said leading side thereof; providing means for bending hose, as the hose is being cut by said cutting means; positioning said bending means at a position spaced from said cutting means and proximate said trailing side of said cutting means; providing means for supporting hose, said supporting means being located between said measuring means and said leading side of said cutting means providing means for moving hose along pathway; in a direction along its axis along a path from a first position in which its free end is located proximate said measuring means, to a second position in which the selected position is located proximate said cutting means and wherein said free end portion is located proximate said bending means; passing the cutting means through hose; operating said bending means generally simultaneously with said cutting means to bend the hose, such that the axis of the terminating free end portion is moved along a path between a position in which the axis of the terminating free end portion of the hose, and the portion of the hose located between the cutting means and the measuring means defining an angle less than 180°; said supporting means operating generally simultaneously with said cutting means and said bending means to support a generally central portion of the hose immediately adjacent the cutting means and to the leading side thereof to maintain the axis of the central portion of the hose in a substantially co-linear relationship with said first line.

Figure 11:
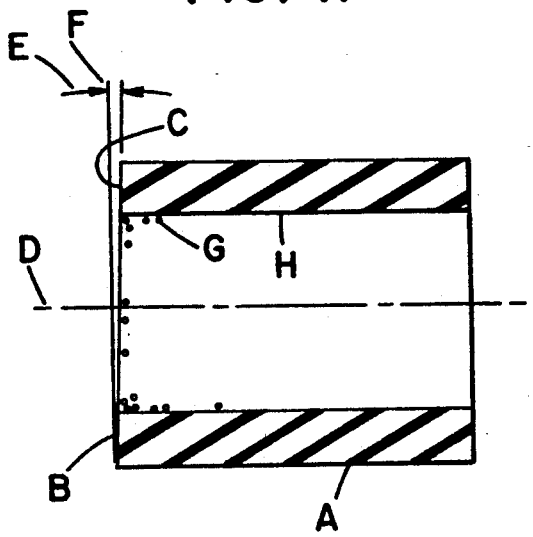
FIG. 11 is a fragmentary, enlarged, side elevational view of a terminating end of a piece of hose, illustrating parameters or characteristics of a cut through hose.

Returning now to FIG. 11, it has been found that using the apparatus system, and method of the present invention, it is possible to cut hose with angle E being less than 3°. Typical prior art systems have been unable to achieve this degree of accuracy, particularly for hoses of relatively large outer diameter. An apparatus according to the present invention is able to cut hose of up to 1.5 inches outer diameter while maintaining angle E to less than 3°.

It is to be understood that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principals of the invention to the full extent indicated by the broad general meaning of the terms in which the appendant claims are expressed.

What is claimed is:

1. A method of cutting hose having a longitudinal axis and terminating at one free end portion, comprising the steps of:

(a) providing cutting means for severing a hose generally across its diameter at a selected position along its length; said cutting means having a leading side and an opposite trailing side;

(b) providing means for measuring hose length as hose passes said measuring means with the axis of the hose lying along a first line;

(c) positioning said measuring means at a position spaced from said cutting means, proximate said leading side thereof;

(d) providing means for bending hose, as the hose is being cut by said cutting means;

(e) positioning said bending means at a position spaced from said cutting means and proximate said trailing side of said cutting means;

(f) providing means for supporting hose, said supporting means being located between said measuring means and said leading side of said cutting means;

(g) providing means for moving hose along a pathway; in a direction along the hose's axis along a path from a first position in which a terminating free end portion of the hose is located proximate said measuring means, to a second position in which a selected position along the length of the hose is located proximate said cutting means and wherein said free end portion is located proximate said bending means;

(h) passing the cutting means through hose;

(i) operating said bending means generally simultaneously with said cutting means to bend the hose, such that the axis of the terminating free end portion is moved along a path between a position in which the axis of the terminating free end portion of the hose, and a portion of the hose located between the cutting means and the measuring means define an angle less than 180°;

(j) said supporting means operating generally simultaneously with said cutting means and said bending means to support a generally central portion of the hose immediately adjacent the cutting means and to the leading side thereof to maintain the axis of the central portion of the hose in a substantially colinear relationship with said first line.

2. A method according to claim 1, comprising the further step of providing coolant means for cooling said cutting means as said cutting means cuts through a hose.

3. A method according to claim 2, wherein said coolant means includes means for directing fluid spray onto said cutting means.

4. A method according to claim 3, wherein said coolant means further includes mans for filtering fluid.

5. A method according to claim 4, wherein said coolant means further includes a pump for pumping fluid through said fluid spray directing means.

6. A method according to claim 1, comprising the further step of providing second means for supporting a portion of the hose, as its is being severed, said second supporting means being located along said pathway and between said cutting means and the terminating free end portion of the hose.

7. A method according to claim 1, comprising the further step of constructing and arranging said bending means and said supporting means such that during cutting, the portion of the hose proximate said trailing side of said cutting means is angularly displaced from the portion of the hose proximate said leading side of said cutting means, while the portion of the hose proximate the leading side of said cutting means remains co-axial with said first line.

* * * * *

UNITED STATES PATENT AND TRADEMARK OFFICE

CERTIFICATE OF CORRECTION

PATENT NO. : 5,253,558

DATED : October 19, 1993

INVENTOR(S) : Kenneth J. Guddal, Jr.

It is certified that error appears in the above-identified patent and that said Letters Patent is hereby corrected as shown below:

Column 2, lines 8, 34 and 37, "desireable" should be --desirable--.

Column 2, line 38, insert --and-- after the word "hose".

Column 3, line 2, "posses" should be --passes--.

Column 7, line 36, "accomodate" should be --accommodate--.

Column 7, line 68, "10" should be --110--.

Column 8, lines 11, 12 and 18, "verticle" should be --vertical--.

Column 8, lines 18-19, "proscribed" should be --prescribed--.

Column 8, line 55, delete "illustrated" after the word "cross-"

Column 11, line 58, delete "be" after the word "to".

Column 14, line 29, "position" should be --positioned--.

Column 14, line 50, insert --;-- after the word "means".

UNITED STATES PATENT AND TRADEMARK OFFICE

CERTIFICATE OF CORRECTION

PATENT NO. : 5,253,558

DATED : October 19, 1993

INVENTOR(S) : Kenneth J. Guddal, Jr.

It is certified that error appears in the above-identified patent and that said Letters Patent is hereby corrected as shown below:

Column 14, line 51, delete ";" after the word "pathway".

Column 14, line 51, "its" should be --the hose's--.

Column 15, lines 18-19 "principals" should be --principles--.

Column 15, claim 1, line 44-45, delete ";" after the word "pathway".

Column 16, claim 1, line 20, "colinear" should be --co-linear--.

Signed and Sealed this

Nineteenth Day of April, 1994

Bruce Lehman

*Attest:*

BRUCE LEHMAN

*Attesting Officer*

*Commissioner of Patents and Trademarks*